United States Patent [19]

Bartasius

[11] Patent Number: 4,895,366

[45] Date of Patent: Jan. 23, 1990

[54] TENNIS NET

[76] Inventor: Joseph A. Bartasius, 3713 Valley Parkway, Lake Worth, Fla. 33467

[21] Appl. No.: 300,589

[22] Filed: Jan. 23, 1989

[51] Int. Cl.[4] ..... A63B 61/00

[52] U.S. Cl. ..... 273/29 B; 273/402

[58] Field of Search ..... 273/29 A, 29 B, 26 A, 273/29 BA, 185 A, 410, 402, 404, 408

[56] References Cited

U.S. PATENT DOCUMENTS

| | | | |
|---|---|---|---|
| 2,280,376 | 4/1947 | Clark | 273/29 A |
| 3,215,432 | 11/1965 | Lee et al. | 273/29 A |
| 4,073,491 | 2/1978 | Sepantic | 273/29 B |

FOREIGN PATENT DOCUMENTS

| | | | |
|---|---|---|---|
| 2638037 | 3/1978 | Fed. Rep. of Germany | 273/29 A |
| 8000663 | 4/1980 | United Kingdom | 273/29 A |
| 8203019 | 9/1982 | United Kingdom | 273/29 A |

*Primary Examiner*—T. Brown

*Attorney, Agent, or Firm*—Victor F. Volk

[57] ABSTRACT

A tennis net is disclosed that will confine the balls that hit it. The net comprises two open-spaced meshworks connected at their top edges, and overlapping strips of flexible netting or other barrier material fastened to hang free from the inside surfaces of each of the meshworks. The open spaces in the meshworks are dimensioned such that a standard tennis ball will pass through the meshworks when directed at the framework. As a ball passes through the meshwork it will be intercepted by one of the overlapping strips of flexible petting and fall to the tennis court between the two meshworks.

9 Claims, 2 Drawing Sheets

TENNIS NET

BACKGROUND OF THE INVENTION

In professional tennis matches ball boys are employed to hurry across the court for the purpose of retrieving spent balls that have struck the net and would otherwise present a hazard to the players who are intent on watching the ball in motion. In casual games, however, and particularly during instruction exercises, the expense of ball boys is not justified and it is the purpose of this invention to provide a net that will keep the great majority of spent balls confined off the playing court where the players or instructors will not be required to spend their court time retrieving them.

SUMMARY OF THE INVENTION

The tennis net of my invention comprises a pair of open meshworks made up of pluralities of interconnected strands which define openings that are large enough to permit free passage of a standard tennis ball. There are also means, such, advantageously, as a conventional tennis net tape that folds over it, for suspending the meshworks from a cable.

Essentially, my net comprises a plurality of flexible barrier strips, which, when the net is hung is place, extend horizontally, with their upper edges fastened to one or the other of the meshworks, while their lower edges hang free. The width of these strips exceeds the vertical dimension of the adjacent of the above mentioned openings and the strips overlap each other so as to cover substantially the entire surface of each of the meshworks. This structure insures that the balls that pass through the meshworks will be deflected downwardly by the strips and retained between the meshworks.

Advantageously, the meshworks are fastened together at their upper edge where they attach to a single strip that hangs between them but are spaced apart below that by the the width of the end posts that support the cable. One strip (which advantageously comprises netting, but may alternatively comprise cloth or a polymeric film) is attached to each of the horizontal strands of the meshworks. Typically, the above named openings are about 7 inches (18 cm) in height and 5 inches (13 cm) in width.

BRIEF DESCRIPTION OF THE DRAWING

FIG. 6 is an elevation of a portion of meshwork supporting strips of polymeric film.

DETAILED DESCRIPTION OF PREFERRED EMBODIMENT

Figure 1:
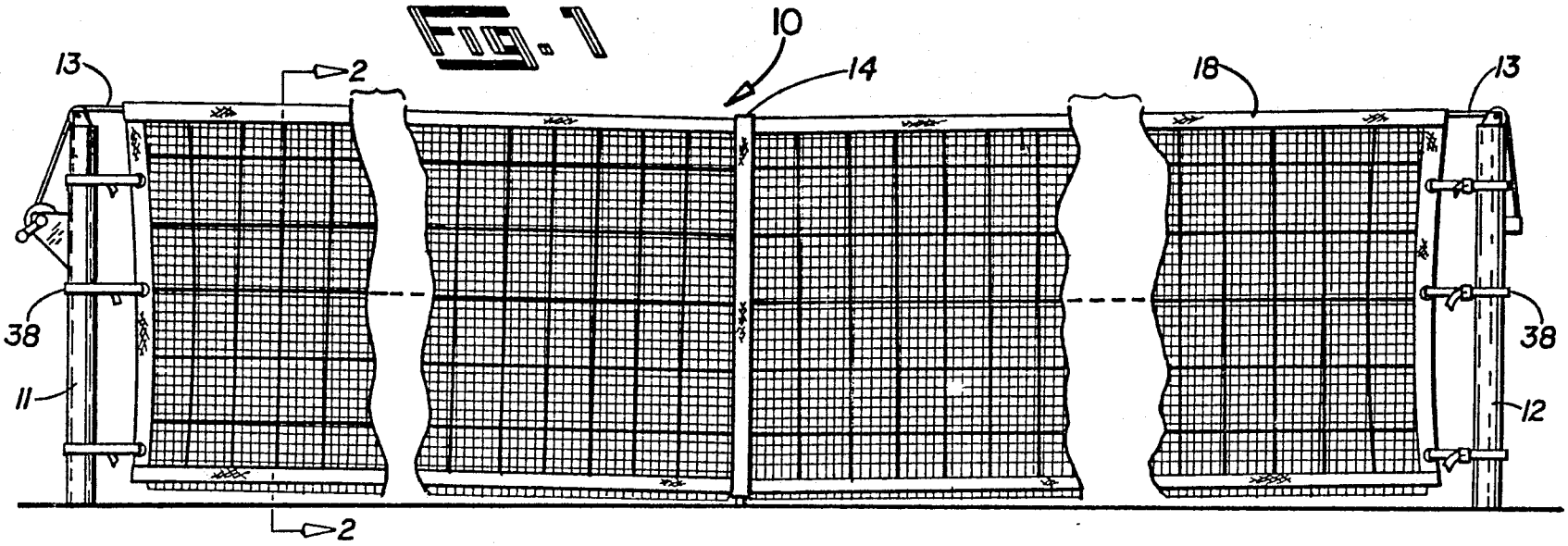
FIG. 1 is an elevation of the net of my invention in position for play.
Figure 4:
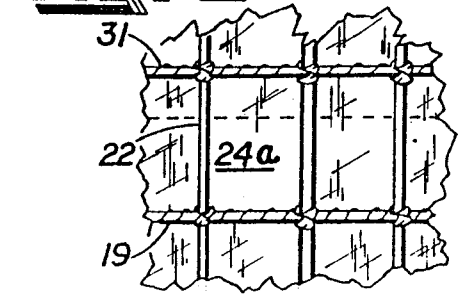
FIG. 4 is an elevation of a portion of meshwork supporting strips of netting.
Figure 3:
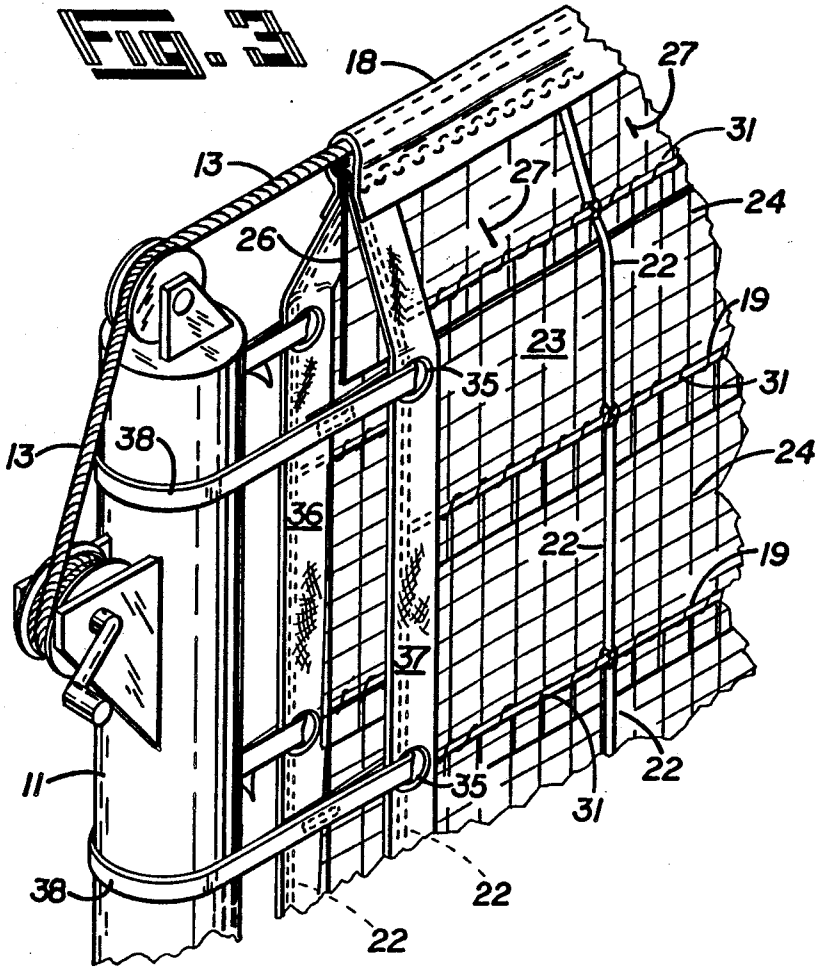
FIG. 3 is a pictorial view of an end post and the means of attachment of the net of FIG. 1 thereto.
Figure 2:
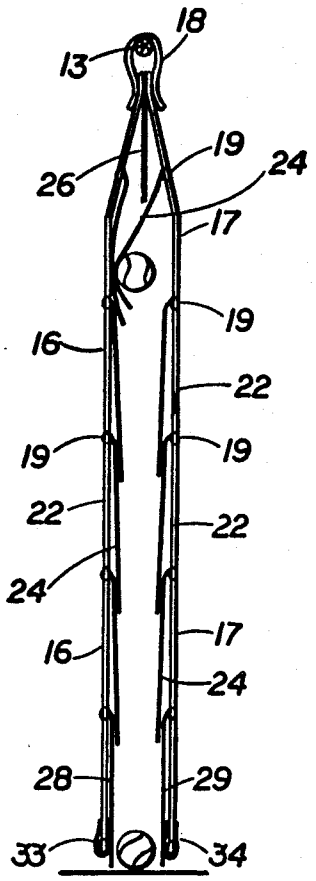
FIG. 2 is a section through the line 2—2 of FIG. 1.

My net 10 as seen in FIG. 1 is stretched between two standard posts 11, 12 from a cable 13 so that it can be constrained by a strap 14 at its center, in the conventional manner, to a height of 36 inches (0.914 m). As can best be seen in FIG. 3 the net 10 comprises two open meshworks 16, 17 (FIG. 2) connected at their upper edges to a tape 18 which folds over the cable 13 and suspends the meshworks from it. The meshwork 17 (and similarly the meshwork 16) is made up of horizontal strands 19—19 tied at cross points such as a cross point 21 (FIG. 4) to vertical strands 22—22. The horizontal strands 19 are spaced about 7 inches apart and the vertical strands 22 about 5 inches apart so that openings, such as an opening 23, will freely permit the entry of a tennis ball which has a diameter of about $2\frac{1}{2}$ inches.

Figure 5:
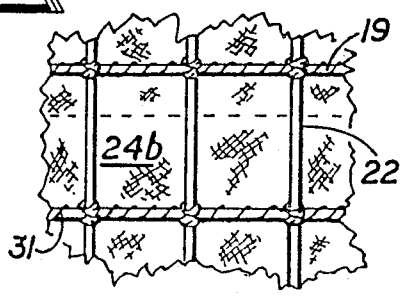
FIG. 5 is an elevation of a portion of meshwork supporting strips of cloth.
Figure 7:
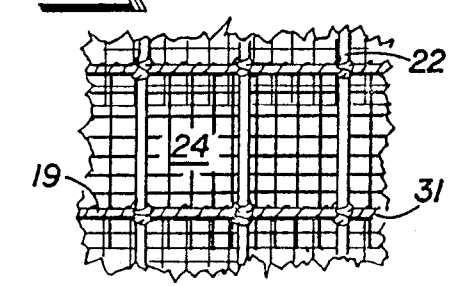

To each of the strands 19 of meshwork 17 (and equivalent strands of the meshwork 16) there is attached such as by means of a spiral filament 31 (FIG. 3) strips which may be polymeric film such, for example, as polyvinyl chloride (the strip **24*a* of FIG. 6), or woven cloth (the strip 24*b* of FIG. 5) or netting (FIG. 4) with a mesh tight enough to stop any tennis ball from passing through it. Netting has the advantage that wind can pass through and that it presents more the aspect to the players of a conventional net, and I have found it preferable to use strips of the netting of a standard tennis net for my strips 24.. Good visibility through the net is required for players at the net to observe their oponents' stroking. This presents an additional advantage for the use of netting for the strips 24**, and, when polymeric sheeting is used, suggests that it be transparent.

When a slow ball passes through the meshwork 17 and strikes one of the strips 24 it is immediately deflected downward between the two meshworks 16, 17. But when a very fast ball passes through an opening 23 it drives a strip 24 attached to the meshwork 17 back against a matching strip that is attached to the meshwork 16. This, in turn, is driven against that meshwork. However, the strips 24 are about 9 inches wide, exceeding the 7-inch vertical spacing of the openings 23 so that the deflection of the strips is positively limited by the presence of the meshwork 16 to stop the fastest ball and let it drop down. Similarly, a fast ball which passes from the opposite court through the meshwork 16 eventually forces one of the strips to be stopped by the meshwork 17.

The two meshworks 16, 17 are joined together at their tops within the tape 18 along with a single strip 26 of flexible barrier material which hangs free between them. The uppermost openings 27—27 of the meshworks are not as long, vertically, as the openings 23 so that the strip 26 need not be as wide as the strips 24. Lowermost strips 28, 29 on each of the meshworks need not be as wide as the higher of said strips so long as they are sufficiently wide to reach close enough to the court surface to confine balls that have been trapped. Tapes 33, 34 are applied respectively to the bottoms of the meshworks 16, 17 for abrasion resistance and weighting whereby they more securely confine the spent balls. The two meshworks 16, 17 are spaced apart a distance somewhat exceeding the diameter of a tennis ball. This is accomplished (see FIG. 3) by tying them to opposite sides of the posts 11, 12. For this purpose I have found it advantageous to fold tapes 36, 37 over the vertical ends of the meshworks, covering the end strands of the strands 22. Grommets 35—35 in the tapes 36, 37 are then fitted with adjustable straps or cords 38—38 that fit around the post 11. Matching means are applied at the post 12 to separate the two meshworks at that end of the net 10.

It is an important advantage of my ball entrapping net 10 that it does not have too much bulk or weight to prevent its being handled similarly to a conventional tennis net, and it is installed in much the same way. Additionally, the appearance of my net is not so strikingly different from that of a conventional net so as to distract the players, and the balls behave as they do ordinarily except that they do not roll out onto the court. In the practice of my invention the net is strung in much the conventional manner and spent balls can be conveniently collected during a change of sides.

The forgoing description has been exemplary rather than definitive of my invention for which I desire an award of Letters Patent as defined in the appended claims.

I claim:

1. A tennis net having upper and lower longitudinal edges comprising:

(A) a pair of longitudinal meshworks comprised of pluralities of interconnected horizontal and vertical strands, said strands defining openings large enough to permit passage of a standard tennis ball, (B) means connecting together said upper longitudinal edges edges of said meshworks and suspending said meshworks from a cable to define a tennis game net, (C) two pluralities of flexible barrier strips each extending the length of one of said meshworks and being located between said pair of meshworks, said strips having upper and lower edges, the upper edge of each of said strips being fastened lengthwise to one of said horizontal strand and the lower edge of each of said strips hanging free, the width of each of said strips exceeding the vertical dimension of an adjacent said opening, said strips overlapping so as to cover substantially the entire surfaces of said meshworks, whereby, said net being suspended in use, balls passing through said openings of each meshworks will be deflected downwardly by strips and rest between said meshworks.

2. The tennis net of claim 1 wherein said connecting means comprises a folded tape.

3. The tennis net of claim 1 wherein an uppermost of said strips is fastened to both of said meshworks.

4. The tennis net of claim 1 wherein said strips are fastened to consecutive of horizontal strands of said meshworks.

5. The tennis net of claim 1 comprising end posts supporting said cable said meshworks being spaced apart by the width of said end posts.

6. The tennis net of claim 1 wherein said strips comprise polymeric film.

7. The tennis net of claim 1 wherein said strips comprise cloth.

8. The tennis net of claim 1 wherein said strips comprise netting.

9. The tennis net of claim 1 wherein said openings are about 7 inches (18 cm) in height and about 5 inches (13 cm) in width.

* * * * *